United States Patent [19]

Gelatini

[11] Patent Number: 5,010,741

[45] Date of Patent: Apr. 30, 1991

[54] CHILLED FOOD DISPLAY COUNTER

[76] Inventor: Lori J. Gelatini, 4637 Greenbush Dr., Concord, Calif. 94521

[21] Appl. No.: 560,344

[22] Filed: Jul. 31, 1990

[51] Int. Cl.[5] ..... A47F 3/04

[52] U.S. Cl. ..... 62/246; 62/275; 62/340; 312/116

[58] Field of Search ..... 62/275, 459, 246, 344, 62/351, 340; 312/116, 236, 284, 351

[56] References Cited

U.S. PATENT DOCUMENTS

| | | | |
|---|---|---|---|
| Re. 20,966 | 1/1939 | Ottenheimer | 62/37 |
| 1,712,890 | 5/1929 | La Hatte . | |
| 1,924,505 | 8/1933 | Long | 312/171 |
| 3,575,481 | 4/1971 | Phileger, Jr. | 312/228 |
| 3,590,596 | 7/1971 | Johnson | 62/275 |
| 3,756,681 | 9/1973 | Croston | 312/351 |
| 4,200,346 | 4/1980 | Belokin, Jr. | 312/351 |
| 4,270,819 | 6/1981 | Ooho | 312/116 |
| 4,375,758 | 3/1983 | Simmons | 62/459 X |
| 4,572,598 | 2/1986 | Moore, Jr. | 312/284 |
| 4,574,594 | 3/1986 | Simmons et al. | 62/459 X |
| 4,766,736 | 8/1988 | Waldschmidt | 62/275 |

*Primary Examiner*—Lloyd L. King
*Attorney, Agent, or Firm*—Schapp and Hatch

[57] ABSTRACT

A counter for displaying chilled foods such as raw fish on a bed of ice contained in a waterproof tray portion having a drain conduit and heating means for melting the ice in the tray and draining the melted ice with scraps of fish and other debris from the tray through a garbage disposal unit for discharge into a waste water drain, control means being provided for automaticalaly turning on and off the garbage disposal unit and the heating means at preselected times for periods of predetermined duration, the counter further being provided with a source of water under pressure for further washing of the fish scraps and debris from the tray, and wherein an ice making machine is mounted above the tray for replenishing the bed of ice as required, and a refrigerated storage compartment is provided in a base enclosure supporting the tray for containing the fish or other chilled foods while the scraps of fish and debris and used ice are being drained from the tray portion and the bed of ice is being replenished.

6 Claims, 1 Drawing Sheet

CHILLED FOOD DISPLAY COUNTER

BACKGROUND OF THE INVENTION

1. Field of the Invention.

This invention relates to counters for displaying chilled food on a bed of ice, and more particularly to counters for displaying fresh fish.

2. Description of the Prior Art.

Conventionally, fresh fish is displayed upon a bed of ice to keep the fish cold and prevent the development of offensive odors. Over a period of a few hours, and especially by the end of the day, scraps of fish shell, and other debris have become distributed in the bed of ice, and the display begins to smell. At the end of the day, particularly for stores which stay open in the evening, the smell often becomes so offensive that customers are driven away from the store.

The usual fish display counters provide a shallow tray into which crushed, chopped or cubed ice is placed to form an ice bed. Usually, the trays have a drain hose leading to a floor drain for removing liquid water as the ice melts. When further ice is required, the storekeeper obtains ice from a central icemaking facility in the store, lifts up the fish and throws scoop of fresh ice onto the ice bed.

At closing time, the storekeeper removes the fish and transports it to a central refrigerating unit for overnight storage. At times, if the fish has developed a strong odor, such odor will be imparted to other foods such as fruits and vegetables also stored in the refrigerating unit.

After the fish is removed, the storekeeper scoops up the ice in the tray and loads it into a plastic garbage can when it is allowed to melt, partially or fully, before being dumped into the floor drain.

At the beginning of the next work day, the storekeeper obtains tubs of ice from the central icemaking facility and shovels it into the tray to form a fresh bed of ice. The fish are then transported from the refrigerating facility to the counter and are arranged on the bed of ice.

As each of the described operations takes place, bits of fish and contaminated ice can escape and help create the offensive smell.

The foregoing commentary also applies to other situations where chilled food is displayed on a bed of ice, for example, salad bars for supermarkets and restaurants. The odor problem is not as great with salad bars as with fish displays but offensive smells can occur. The laborious transporting of the chilled food to a refrigerating facility, removal of the used ice bed, cleaning of the unit, and replenishment of the ice bed from a separate icemaking facility presents similar problem in the case of salad bars and the like. Typical of such salad bars is the construction shown in U.S. Pat. No. 4,572,598, issued Feb. 25, 1986 to Franklin Moore, Jr.

Ice is sometimes used in enclosed cases such as that shown in U.S. Pat. No. Re. 20,966 issued Jan. 3, 1939 to R. E. Ottenheimer and in various containers for transporting fish such as those shown in U.S. Pat. No. 3,575,481 issued Apr. 20, 1971 to G. A. Phlieger, Jr.; U.S. Pat. No. 3,756,681 issued Sept. 4, 1973 to W. G. Croston; and U.S. Pat. No. 4,200,346 issued Apr. 29, 1980 to P. Belokin, Jr. Other examples of display counters which are refrigerated but do not use ice may be found in U.S. Pat. No. 1,712,890 issued May 14, 1929 to C. LaHatte; U.S. Pat. No. 1,924,505 issued Aug. 29, 1933 to H. H. Long; and U.S. Pat. No. 4,270,819 issued June 2, 1981 to M. Ooho.

The above-listed patents are believed to be relevant to the present invention because they were adduced by a prior art search made by an independent searcher, and a copy of each of the above-listed patents is supplied to the Patent and Trademark Office herewith.

SUMMARY OF THE INVENTION

The chilled food display counter of the present invention is particularly well suited for displaying odor producing foods such as raw fish under circumstances which greatly reduce or eliminate offensive odors. To accomplish this, the display counter provides a unitary assembly having provisions for displaying and storing the fish or other displayed foods under conditions reducing or eliminating offensive odors. The present display play counter also is easily and readily cleanable on the spot.

Basically, the present display case provides a waterproof tray portion having a generally flat bottom surrounded by an upstanding wall of sufficient height for the tray to contain a bed of ice of desired depth upon which the fish or other chilled foods are displayed for sale. The bottom of the tray is flatly inclined downwardly to a drain opening, and a drain conduit communicates with the drain opening for discharging drainage into waste water drain.

Heating means, such as an electrical resistance heating element, is operatively associated with the tray for melting the ice therein when the fish or other chilled food is removed from the bed of ice, as would occur at the end of the day when the store closes.

During the day, scraps of fish, shell, and other debris become distributed in the bed of ice and, after a few hours, begin to generate an offensive odor. At the end of the day, or whenever such odor becomes apparent, the fish is removed from the bed of ice and stored under refrigeration. The contaminated ice is quickly melted by turning on the heating elements and the resulting contaminated water bearing scraps of fish, shell and other debris immediately drains off.

To facilitate rapid removal of the contaminated ice, a garbage disposal unit is interposed in the drain conduit for grinding up scraps of food and debris draining from the tray and thus facilitate their passage into the waste water drain. As a feature of the invention, control means is provided for automatically turning on and off the garbage disposal unit and the heating means at preselected times for periods of predetermined duration. This control means is in the form of an electrically driven timer or clock which supplies electrical current to the garbage disposal unit and heating means for the periods of time required to clean out the tray portion.

A source of water under pressure is provided for further washing food scraps and debris and used ice from the tray portion through the drain conduit and garbage disposal unit and into the waste water drain. Concurrent use of the heating elements, the garbage disposal unit, and the source of water under pressure results in a very rapid and thorough cleaning out of the water-proof tray portion. This rapid cleaning feature makes it possible to remove odor producing material in a short period of time so as to interfere as little as possible with the fish display function of the counter.

Also in order to speed up the formation of a new bed of clean ice in the tray portion, an ice making machine preferably is mounted above the tray portion so it can discharge the ice being made directly into the tray portion and quickly build up a new bed of ice.

In accordance with the present invention, the tray portion is mounted upon a base enclosure, and a refrigerated storage compartment is provided in the base enclosure for containing the fish or other chilled foods for overnight storage or while the scraps of food, debris and used ice are being drained from the tray portion and the bed of ice is being replenished.

It is therefore a principal object of the present invention tion to provide a counter for displaying chilled foods on a bed of ice, the counter being adapted for rapid, easy and thorough cleaning of scraps of food, debris and used ice from the tray portion which supports the bed of ice.

Another object of the present invention is to provide a counter for displayed chilled foods on a bed of ice of the character described in which scraps of food and debris drainin from the tray portion are ground up and mixed with water to facilitate their passage into a waste water drain.

A further object of the present invention is to provide a counter for displaying chilled food on a bed of ice of the character described which is capable of automatically grinding up the scraps of food and debris and heating the tray portion supporting the bed of ice at preselected times for periods of predetermined duration.

A still further object of the present invention is to provide a counter for displaying chilled foods on a bed of ice of the character set forth in which a source of water under pressure is provided for further washing food scraps and debris and used ice from the tray portion, and means is provided for replenishing the bed of ice as required.

Yet another object of the present invention is to provide a counter for displaying chilled foods on a bed of ice of the character described in which the various operating component and the tray portion are mounted upon a structure having refrigerated compartments for containing the chilled foods while the scraps of food and debris and used ice are being drained from the tray portion and the bed of ice is being replenished.

Other objects and features of advantage will become apparent as the specification progresses, and from the claims.

Figure 1:
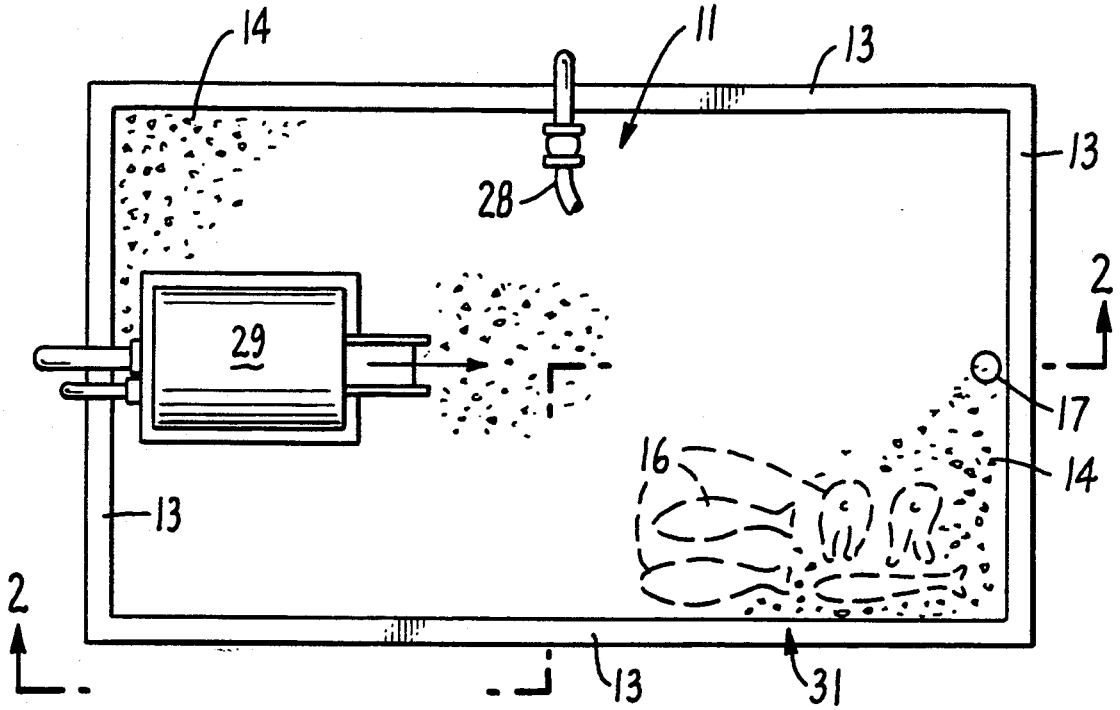
FIG. 1 is a plan view of a display counter constructed in accordance with the present invention. 11
Figure 2:
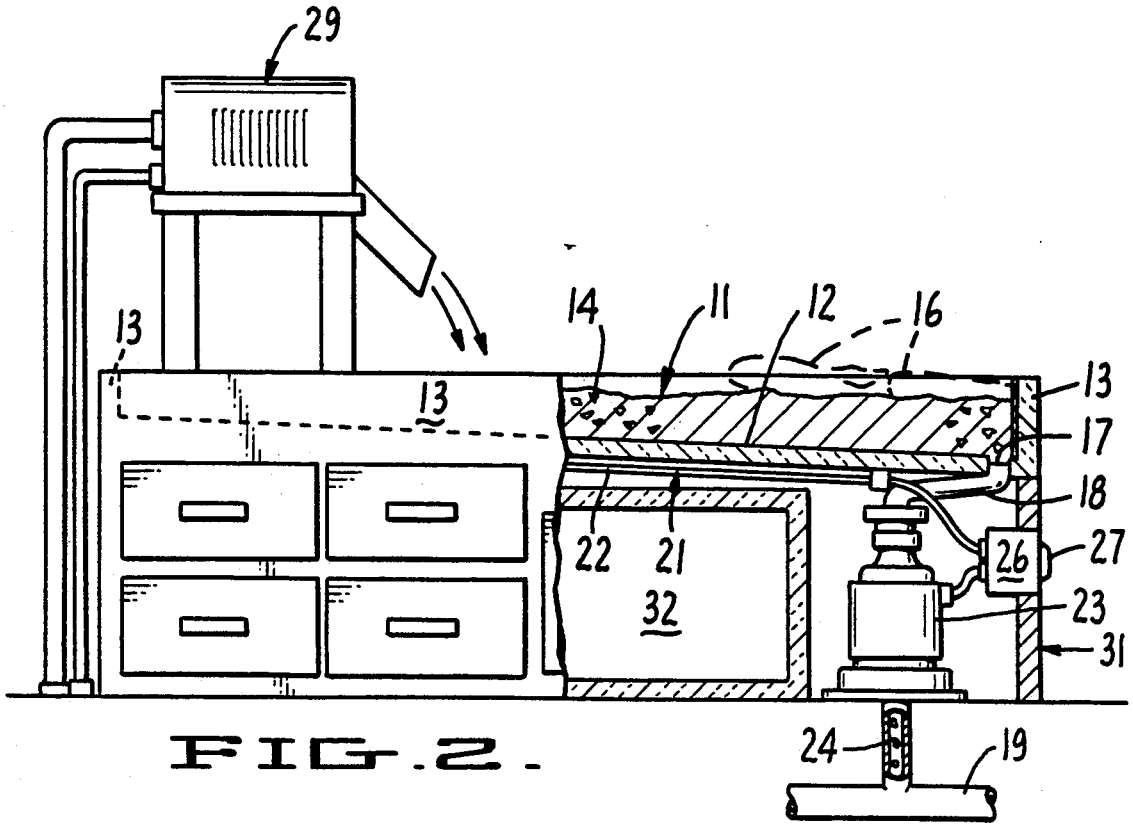
FIG. 2 is a vertical cross-sectional view taken substantially on the plane of Line 2—2 of FIG. 1.

While only the preferred form of the invention is illustrated in the drawing, it will become apparent that various modifications could be made without departing from the ambit of the claims.

DESCRIPTION OF THE PREFERRED EMBODIMENTS

The chilled food display counter of the present invention provides a waterproof tray portion 11 having a generally flat bottom 12 surrounded by an upstanding wall 13 of sufficient height for the tray 11 to contain a bed of ice 14 of desired depth upon which chilled foods such as raw fish 16 are display for sale, the bottom 12 of tray 11 being flatly inclined downwardly to a drain opening 17 communicating with a drain conduit 18 adapted for discharging into a waste water drain 19.

Heating means 21 is operatively connected to the tray 11 for melting the ice 14 therein when the fish 16 is removed from the bed of ice 14, as at the end of the day. The heating means 21 preferably is electrically operated and, as here show is in the form of an electrical heating elements 22 mounted in close proximity to the tray portion 11, which is formed of a suitable sheet metal such as stainless steel.

In accordance with the present invention, a garbage disposal unit 23 of conventional design is interposed in the drain conduit 18 for grinding up scraps of fish and debris draining from the tray 11 with the water from the melted ice so as to facilitate the passage of the scraps of fish and debris 24 into the waste water drain 19.

As a feature of the present invention, control means 26 is provided for automatically turning on and off the garbage disposal unit 23 and the heating means 21 at preselected times for periods of predetermined duration. As here shown, the control means 26 is in the form of an electrical timer 27. A sour of water under pressure such as hose 28 is provided for further washing scraps of fish and debris 24 and used ice 14 from the tray portion 11, through conduit 18 and garbage disposal unit 23, and into the waste water drain 19.

In order to save time and reduce transport time between the display counter and a central source of ice, an ice making machine 29 is mounted above the tray portion 11 for replenishing the bed of ice 14 as required. As here shown, the ice making machine 29 discharges directly onto the waterproof tray portion 11, where the ice can be quickly spread out to form the bed of ice 14.

As a feature of the present invention, the tray portion 11 is mounted upon a base enclosure 31, and a refrigerated storage compartment 32 is provided in the base enclosure 31 for containing the fish or other chilled food while the scraps of fish and debris 24, and used ice, are being drained from the tray portion 11 and the bed of ice 14 is being replenished. The tray portion 11, the drain conduit 18, the electrical heating element 22, the garbage disposal unit 23, the control means 26, the hose 28, and the ice making machine 29 are all formed into a unitary assembly by mounting them on the base enclosure 31.

From the foregoing, it will be apparent that the counter of the present invention for displaying chilled foods, such as raw fish, provides a novel and extremely useful structure which displays the fish or other chilled food on a bed of ice and which is readily cleanable and in which the bed of ice can easily be replenished, all without any necessity for leaving the vicinity of the counter.

What is claimed is :

1. A counter for displaying chilled foods on a bed of ice, comprising a waterproof tray portion having a generally flat bottom surrounded by an upstanding wall of sufficient height for said tray to contain a bed of ice of desired depth upon which chilled foods are displayed for sale, said bottom of said tray being flatly inclined downwardly to a drain opening, a drain conduit communicating with said drain opening and adapted for discharging into a waste water drain, and heating means operatively connected to said tray for melting the ice therein when said chilled food is removed from said bed of ice at the end of the day.

2. A counter as described in claim 1, and wherein a garbage disposal unit is interposed in said drain conduit for grinding up scraps of food and debris draining from said tray portion to facilitate their passage into said waste water drain.

3. A counter as described in claim 2, and wherein control means is provided for automatically turning and off said garbage disposal unit and said heating means at preselected times for period of predetermined duration.

4. A counter as described in claim 1, and wherein a source of water under pressure is provided for further washing food scraps and debris and used ice from said tray portion.

5. A counter as described in claim 1, and wherein a ice making machine is mounted above said tray portion for replenishing said bed of ice as required.

6. A counter as described in claim 1, and wherein said tray portion is mounted upon a base enclosure, and a refrigerated storage compartment is provided in said base enclosure for containing said chilled foods while said scraps of food and debris and used ice are being drained from said tray portion and said bed of ice is being replenished.

* * * * *